United States Patent [19]

Schumann et al.

[11] 4,287,871

[45] Sep. 8, 1981

[54] ZERO CLEARANCE MOBILE HOME FIREPLACE UNIT

[75] Inventors: George Schumann, Vanderhoof, Canada; Jerry Beckstead, Glenrock, Wyo.

[73] Assignee: Energy Research International, Nassau, The Bahamas

[21] Appl. No.: 953,759

[22] Filed: Oct. 23, 1978

[51] Int. Cl.[3] ..... F24B 3/00; F24C 1/14; F24B 7/00

[52] U.S. Cl. ..... 126/67; 126/77; 126/121; 126/131

[58] Field of Search ..... 126/121, 67, 77, 131; 137/875

[56] References Cited

U.S. PATENT DOCUMENTS

| | | | |
|---|---|---|---|
| 2,452,898 | 11/1948 | Bourdette | 137/875 |
| 4,004,731 | 1/1977 | Zung | 126/121 |
| 4,010,728 | 3/1977 | Hempel et al. | 126/121 |
| 4,074,679 | 2/1978 | Jensen | 126/131 |
| 4,169,458 | 10/1979 | Shaw | 126/121 |

*Primary Examiner*—Albert W. Davis
*Assistant Examiner*—Wesley S. Ratliff, Jr.
*Attorney, Agent, or Firm*—LeBlanc, Nolan, Shur & Nies

[57] ABSTRACT

An efficient zero clearance fireplace, space heater is disclosed which is adaptable for installation in either mobile homes or permanent structures. The fireplace unit consists of a stainless steel firebox with an opening for access to the interior thereof. The firebox is surrounded by a first metal skin spaced therefrom which mounts glass doors across the opening. The outer surface of the top, bottom, sides, and back of the first skin are sheathed with an insulating felt. A second metal skin surrounds the first on the sides, back, and top. Outside air is circulated between the firebox and first skin, and heated thereby as the sole source of combustion air. This heated air is also circulated into the room through vents in the front of the first skin. Cool room air from the floor circulates upwardly between the first and second skins only to cool the unit. An optional damper and combustion air control is provided.

7 Claims, 8 Drawing Figures

ZERO CLEARANCE MOBILE HOME FIREPLACE UNIT

This invention relates to efficient fireplace units and in particular to a unit which is adaptable for zero clearance installation in a mobile home against any type wallboard material. The device of this invention is designed to efficiently consume fuel in a controlled fire with negligible partially burned combustion productions being formed. In addition the unit is designed to pressurize the room in which it is mounted by using outside air only as the combustion source of oxygen and by heating a portion of the outside air admitted to the unit for circulation into the room. Cool room air from the floor is also circulated around the unit.

In order to utilize a fireplace in a mobile home, the unit must not utilize, as an oxygen source, air from within the room to be heated. In addition, a damper or other obstruction in the flue is not allowed. Accordingly, a conventional fireplace would provide a safety hazard in a mobile home.

As discussed, for example, in U.S. Pat. No. 4,059,090, owned by the assignee of this patent application, the common domestic open fireplace heats a room primarily with radiant energy from the fire, and as is well known, the vast majority of the heat of combustion is lost via the chimney. In addition, fuel is only incompletely consumed creating visible smoke, sparks and the like which exit the fireplace through a chimney.

In addition, an open fireplace draws warm air from within the house into an open flue with the combustion gases. Therefore, the open fireplace not only depletes oxygen within the room, but depressurizes the room so that cold air will be drawn in through cracks and openings around doors and windows. Accordingly, an open fireplace is a highly inefficient heating device.

There have been past attempts to design efficient fireplace type heating units. The above-noted patent is one attempt whereby combustion air is drawn into the fireplace through a controlled vent, and outside air is circulated around the firebox and through the flue for heating to be expelled into the room.

Another type unit is shown in U.S. Pat. No. 4,074,679. In this unit, however, the firebox is lined with firebrick to absorb heat so that the exterior of the device will be sufficiently cool to avoid a safety hazard. This device, however, loses efficiency marketedly as an air heater by utilizing firebrick between the fire, itself, and the heat exchange surface which the air to be heated is passed over.

It has been discovered, however, that a compact and efficient fireplace unit can be constructed according to this invention which will utilize outside air as a sole source of combustion air with a controlled amount being admitted to the firebox. Outside air also is circulated around the firebox to be heated and expelled into the room whereby the room is pressurized with heated air to minimize the flow of cold air into the structure through cracks around doors and windows. The device of this invention then does not depend upon oxygen within the room for combustion. In addition, it has been discovered that by circulating the combustion air around the firebox before admission to the interior thereof, a much more efficient, controlled combustion will take place within the unit whereby the smoke rising from the chimney will consist almost entirely of complete products of combustion and therefore will be invisible. Furthermore, heated combustion air has been found to facilitate complete combustion of the fuel to a powdery ash whereby cleaning the unit to remove the ashes will be necessary only infrequently.

In addition, the efficient design of the device of this invention permits the manufacture of a small compact unit which may be mounted on any firm floor against any type of wall construction material, whether plasterboard, wood, or the like. In extensive tests, the unit of this invention has been found to comply with accepted standards for zero clearance installation in mobile homes or other structures.

Accordingly, it is an object of this invention to provide a fireplace heating unit which will utilize outside air exclusively as a source of combustion oxygen.

It is another object of this invention to provide a fireplace heating unit which may be mounted directly against any wall material without providing a clearance or dead air space for safety purposes.

It is yet another object to provide a fireplace space heating unit which will efficiently heat outside air and room air and expel the heated air into the room whereby the structure will be pressurized against the admission of cold air from around windows, doors, and the like.

It is still another object of this invention to provide a metal zero clearance fireplace unit which will efficiently preheat combustion air so that the fuel consumed in the unit will be completely consumed and the pollutants expelled therefrom into the atmosphere will be negligible.

These and other objects will become readily apparent with reference to the drawings and following description wherein.

Figure 1:
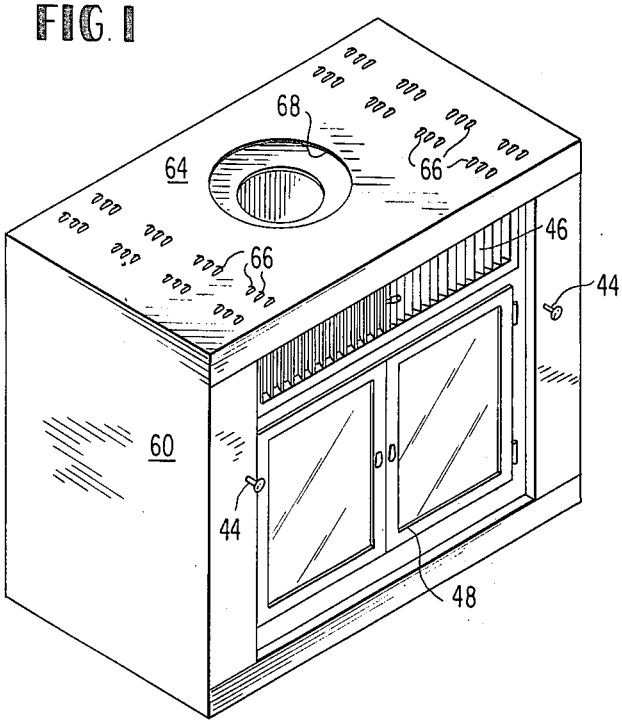
FIG. 1 is a perspective view of the unit of this invention without the flue.
Figure 2:
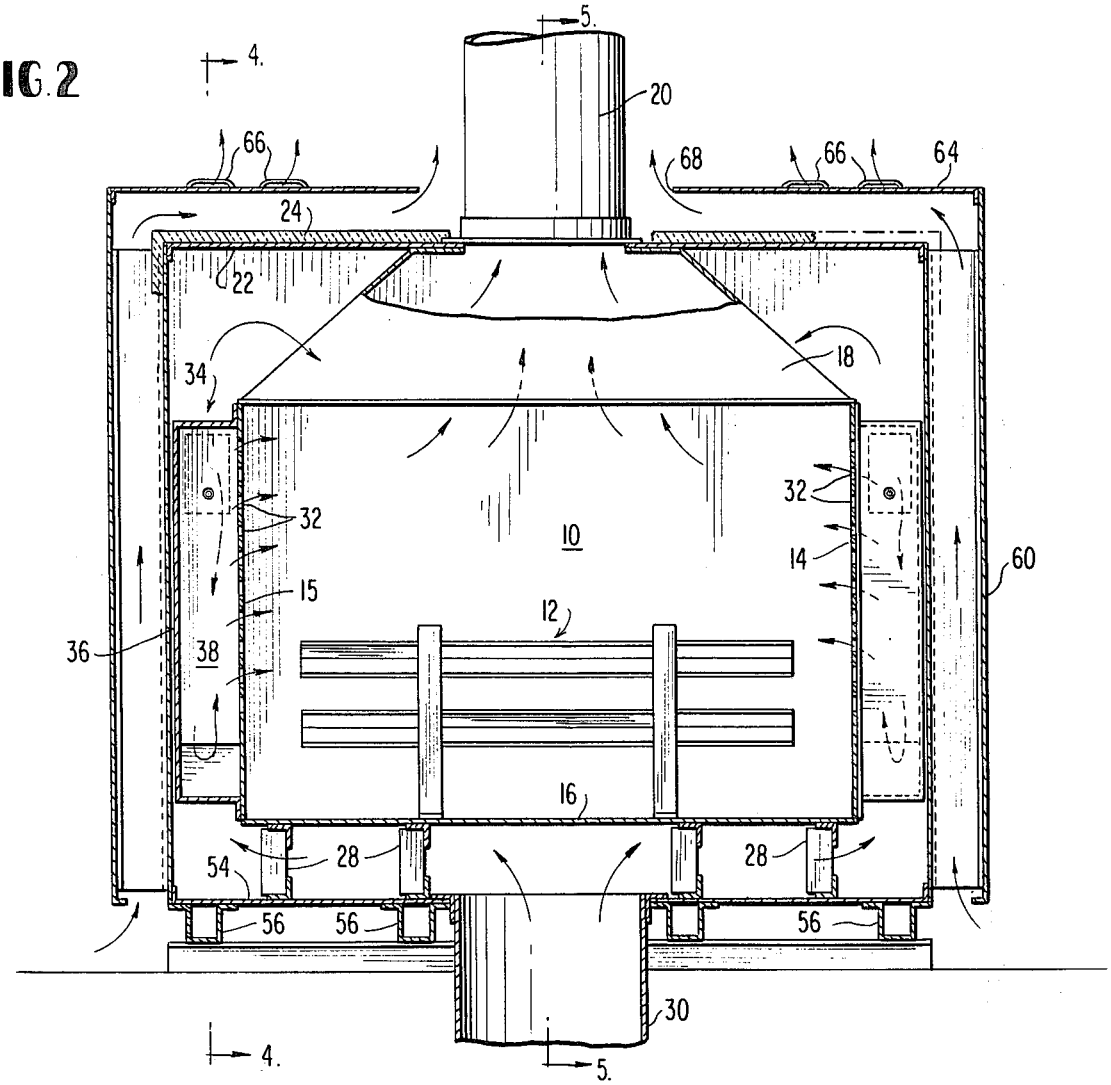
FIG. 2 is a cross-sectional view of the device of this invention with a portion of the insulating material removed and the inlet and flue pipes broken away.
Figure 3:
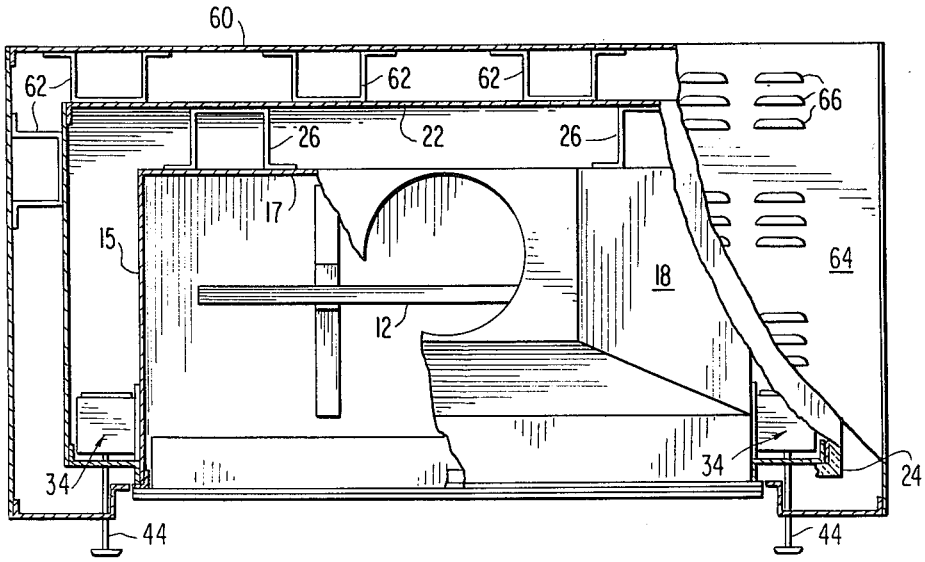
FIG. 3 is a top view of the device of FIG. 1 with top portions reviewed to illustrate the interior structure.

With attention to the drawings and to FIGS. 1-3 in particular, the device of this invention includes a firebox 10 which mounts, preferably, a log retainer 12 on the floor thereof. Firebox 10 consists of right and left sides 14 and 15, a floor 16, a back 17 and a hood 18. Hood 18 connects the upper portion of box 10 to a flue 20.

Preferably fuel is placed between the retainer 12 and the back 17 of firebox 10. However, as will be obvious to those skilled in the art, andirons may be substituted for retainer 12, if desired. The products of combustion then leave the firebox 10 through hood 18 and enter the flue 20 and exit to the atmosphere.

Firebox 10 and hood 18 are surrounded by a first metal skin 22 on both sides, the back, bottom, and top. The outer surface of skin 22 mounts an insulation sheath 24. The sheath 24 is preferably a silica-alumina felt such as Fiberflax. Fiberflax ½ inch Duri-blanket felt has a density of 6 pounds per cubic foot, and will withstand 2300° F. on a continuous basis with a melting point above 3200° F. Fiberflax is a trademark of The Carborundum Company of Niagara Falls, N.Y.

As shown in FIG. 3, vertical channel spacer members 26 separate the firebox back 17 and the first metal skin 22 to provide a space for the circulation of air to be warmed. In addition, firebox 10 is mounted on feet 28. A conduit 30 extends through an opening in the bottom of skin 22 to provide outside air to be heated. The outside air preferably is drawn into the device by a fan (not shown). As will be obvious to those skilled in the art, the vent (not shown) for conduit 30 should be controlled so that it may be fully closed when the fireplace of this invention is not in use. Air to be heated then enters the device through conduit 30 and circulates in the space between the firebox and the inner surface of skin 22. A portion of this air enters the firebox 10 through a plurality of ports 32 mutually spaced along the front portion of sides 14 and 15.

Figure 4:
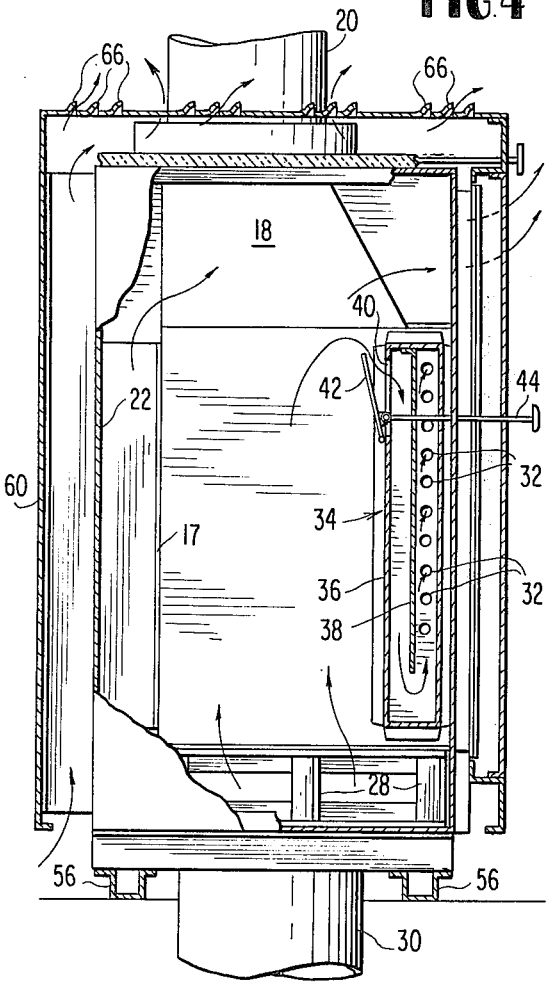
FIG. 4 is a cross-sectional view taken along line 4—4 of FIG. 2.

With attention to FIGS. 2 and 4, a preferred embodiment of this invention utilizes a combustion control assembly 34 to control the combustion air admitted through ports 32. The control assembly consists of a housing 36 which surrounds ports 32. Housing 36 contains a baffle plate 38. Combustion air enters assembly 34 through a port 40. Port 40 is controlled, preferably, by a door 42 pivotally mounted on housing 36. An exterior handle 44 is provided so that the door may be opened and closed.

Combustion air then enters port 40 and circulates around baffle plate 38 to be admitted to firebox 10 through ports 32. As will be obvious to those skilled in the art, port 40 may be located as shown in FIG. 4, or it may be located in the bottom portion of housing 36 with an internal circulation in the opposite direction and with baffle plate 38 disposed accordingly. The purpose of the control assembly is to further preheat the combustion air, as will be subsequently explained. Combustion air circulates around firebox 10, enters port 40 and circulates around baffle plate 38 whereby it becomes heated before being admitted to the interior of firebox 10 through ports 32.

Figure 5:
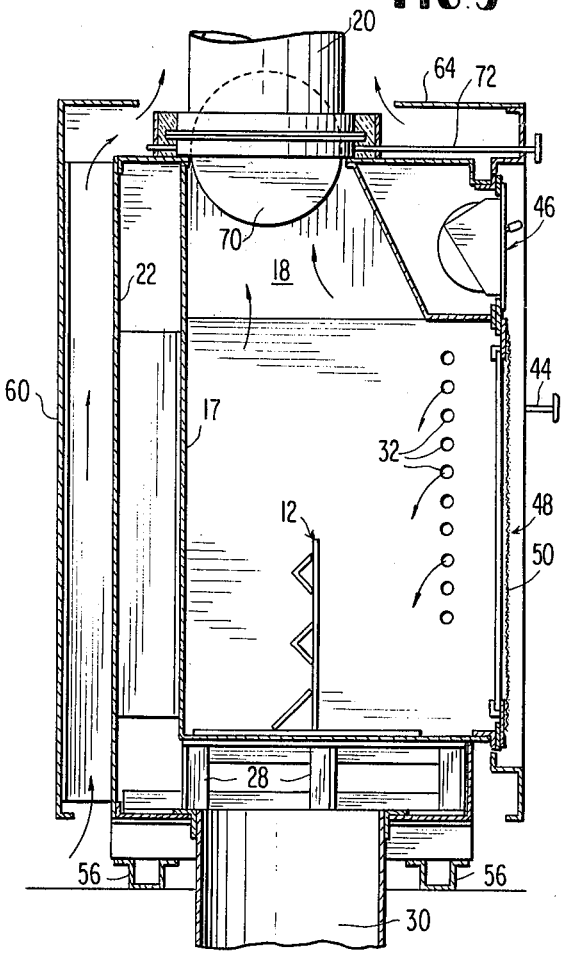
FIG. 5 is a view similar to FIG. 4 taken along line 5—5 of FIG. 2 and showing an optional damper in the flue.

As shown in FIGS. 1 and 5, the first metal skin 22 also mounts a vent opening or grille 46 along the upper portion thereof directly in front of hood 18. Therefore, air circulating around the firebox 10 will exit into the room to be heated through vent 46. Vent 46 may then be closed or opened in the conventional fashion to control the flow of heated air from the device of this invention into the room. Glass doors 48 are also provided to control access to the interior of firebox 10. Doors 48 preferably have a wire mesh 50 covering the inner surface thereof. Doors 48 are intended to insure that no room air enters the firebox 10 to exit the room through flue 20, except, of course, when fuel is being placed into the firebox 10. In addition, room air cannot be admitted into the space between the walls of firebox 10 and the first skin 22. Therefore, the firebox is totally isolated, and cannot deplete the oxygen within the room to be heated. Furthermore, since outside air is continuously circulated around the firebox and expelled through vent 46 into the room, the room will be pressurized by this flow of heated air.

The base 54 of the first skin 22 is supported by feet 56, which in turn rest on the floor. The building codes require a hearth extension in front of the fireplace. However, the device of this invention could safely be placed on a wooden floor.

The device of this invention is further insulated by a second skin 60 which surrounds the first skin on three sides and on the front corners thereof. Skin 60 is separated from skin 22 by a plurality of channel shaped, vertical spacers 62, as shown in FIG. 3. The top 64 of skin 60 forms a plurality of vents 66. As shown in FIG. 2, room air enters the space between the insulated surface 24 of skin 22 and the inner surface of skin 60 at the bottom thereof and circulates upwardly around the first skin 22 to exit at vents 66. A central opening 68 is provided for flue 20 and permits the flow of heated room air upwardly around the flue 20.

Figure 7A:
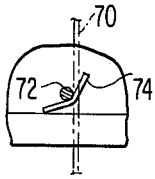
FIG. 7A is a fragmentary view taken along line 7—7 of FIG. 6 showing the damper stop with the damper in the fully open position.
Figure 7B:
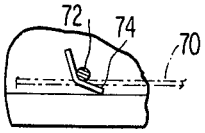
FIG. 7B is a view similar to FIG. 7A illustrating the damper stop with the damper in the fully closed position.
Figure 6:
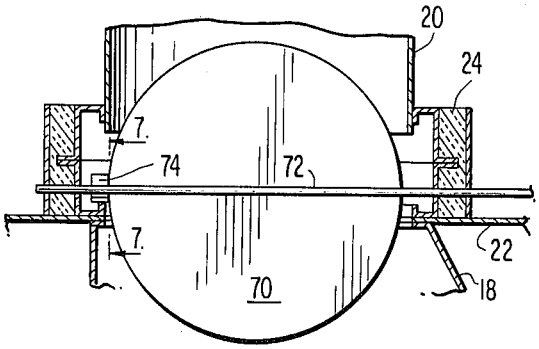
FIG. 6 is a fragmentary view of the optional damper shown in FIG. 5.

As shown in FIGS. 5, 6, 7A and 7B, a damper may be provided in flue 20 if desired. The damper consists of a circular disc 70 mounted on a rod 72 and including a damper stop 74. The damper stop 74 permits movement from a fully open position as shown in FIG. 7A to a fully closed position as shown in FIG. 7B. In mobile home construction, however, safety requirements do not permit the use of a damper. Therefore, if the device of this invention is to be utilized with a mobile home, the damper shown, for example, in FIGS. 5 and 6, would not be included. The necessity for a damper is obviated by the ability to close vent 36 and inlet 42 on control assembly 34. In addition, an outside vent on conduit 30 could be provided to eliminate the flow of outside air to the firebox 10.

The device of this invention then may be mounted against any floor or wall material, and may be fully boxed or enclosed within such materials. In addition, the device of this invention could be externally mounted with a cantilever support in, for example, mobile homes. The need for costly footings is eliminated, but if the fireplace of this invention is installed in a mobile home, it should have leg straps or similar bracing material secured to the foundation of the mobile home so that the device will not be able to move when the mobile home is being transported. The firebox 10 is preferably constructed of stainless steel with the hearth and back of 14 gauge and the sides, front, and hood of 16 gauge. The first skin 22 may be constructed of galvanized steel preferably of 26 gauge. The insulation 24 is preferably a ½ inch thick sheath of Fiberflax insulation, and the outer skin 60 is preferably also 26 gauge galvanized steel. The space between the firebox 10 and the first skin 22 is preferably 4 inches.

In tests conducted with the device of this invention to determine compliance with UL 127 standard for factory built fireplaces, it was found that the maximum temperature rise at the zero clearance to the test unit for a radiant fire was 58° F. above the ambient temperature. The maximum temperature rise above ambient at the zero clearance to the test structure for a brand fire was 89° F. The maximum temperature rise at the zero clearance to the test unit for a flash fire was 106° F. above ambient. Accordingly, the device of this invention was found to comply with the above-identified standards.

In summary then, the device of this invention comprises a compact zero clearance fireplace unit which is fully isolated from the interior to be heated whereby outside air supplies combustion air and air to be heated and expelled into the room surrounding the fireplace. By preheating the combustion air through the circulation of said air around the firebox and preferably through a combustion control assembly of this invention, a plasmatic effect is produced. The combustion air may be preheated up to for example 400° F. before it is admitted to the firebox. The result is virtually complete combustion of the fuel at a rate controlled by the amount of combustion air admitted to the firebox. The products of combustion expelled through the flue have been observed to be virtually invisible as compared to standard fireplaces which produce smoke, sparks, and the like.

Accordingly, the device of this invention is a highly efficient heating unit adapted for use in mobile homes or other structures which is light in weight and occupies a minimum of floor space. Because of the combined insulating effects of the Fiberflax and the room air circulating around the first skin, the device may be mounted against any wall paneling material without danger of fire, or may be fully enclosed.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced herein.

What is claimed is:

1. An isolated fireplace, space heater for utilizing the heat of combustion of fuel therein to heat the interior of a structure without withdrawing air from the interior of said structure for combustion, comprising:

a firebox having a floor, back, and two sides adapted to be disposed within a structure to be heated; hood means mounted on the upper portion of said firebox for collecting gaseous products of combustion from said box; flue means in communication with said hood means for venting said products to the atmosphere external to the structure;

a first metal skin surrounding the floor, sides, and back of said firebox, and said hood means, said first skin being spaced therefrom to define with said box and hood means a first air passage between the outer surface thereof and the inner surface of said skin; means carried by said device for admitting outside air to said air space and for circulating said air therethrough; vent means carried by said first skin for venting outside air from the passage into the interior of the structure to be heated whereby when fuel is consumed in said firebox outside air will be circulated therearound and vented into the structure;

door means coupled to the front of said device for enclosing said firebox and said first skin to isolate the interior of said firebox from the interior of the structure;

control means disposed within the air passage for diverting and preheating a portion of the air therein into the firebox to supply combustion air when fuel is consumed therein; said control means comprising at least one housing mounted on the outer surface of said firebox and having an inlet opening into the first passage and an outlet into said firebox; said housing being an elongated, vertically disposed, hollow member and the outlet including a plurality of vertically arrayed apertures disposed adjacent said door means; baffle means disposed between the inlet and the outlet to define a tortuous pathway between the inlet and outlet for air passing into the firebox; and means carried by said housing for controlling the flow of air through the inlet thereto;

insulating means surrounding the outer surface of said first skin for minimizing heat loss therefrom when fuel is consumed in said firebox; and a second skin surrounding the sides, back, floor and upper portion of said first skin and spaced therefrom to define a second air passage; flow means carried by said device for circulating air from within the structure through said second passage.

2. The device of claim 1 wherein said control means comprises a pair of elongated housings mounted on either side of said firebox, each housing having an inlet opening into the first passage and an outlet opening into said firebox; baffle means disposed within each housing between the inlet and the outlet to define a tortuous pathway therebetween for air passing into the firebox; and means carried by each housing for controlling the flow of air through the inlet thereto.

3. The device of claim 1 wherein said means for admitting outside air to the first air space includes a conduit opening into the air space to the floor of said first skin so that outside air circulates upwardly around said firebox, said vent means comprising an opening in said skin disposed adjacent and in front of said hood means and a movable grating disposed over said opening.

4. The device of claim 1 wherein said flow means includes inlet means adjacent the floor of said device and outlet means at the upper portion of said device so that air from within the structure circulates from the floor upwardly around the first skin through the second air space to exit at the upper portion of said fireplace.

5. The device of claim 1 wherein said flue means comprises damper means for opening and said flue

6. The device of claim 1 wherein said first skin is spaced from said firebox about four inches.

7. The device of claim 1 wherein said firebox is constructed of stainless steel and said first and second skins are constructed of galvanized steel.

* * * * *